United States Patent [19]

Stilling

[11] Patent Number: 4,682,433

[45] Date of Patent: Jul. 28, 1987

[54] FABRIC SIGN PANEL

[76] Inventor: Johann Stilling, 1141 Royal York Road, Apt. A1001, Islington, Ontario, Canada

[21] Appl. No.: 717,318

[22] Filed: Mar. 28, 1985

[51] Int. Cl.[4] ..... G09F 19/00

[52] U.S. Cl. ..... 40/615; 40/2 R; 40/630

[58] Field of Search ..... 40/2, 615, 591, 592, 40/630

[56] References Cited

U.S. PATENT DOCUMENTS 3,751,319 8/1973 Green et al. ..... 40/615
3,925,585 12/1975 Aoyagi ..... 40/2 B
4,429,015 1/1984 Sheptak ..... 40/625
4,532,167 7/1985 Mohr ..... 40/630

*Primary Examiner*—Robert Peshock
*Assistant Examiner*—Wenceslao J. Contreras
*Attorney, Agent, or Firm*—George A. Rolston

[57] ABSTRACT

A vinyl fabric sign having a panel of vinyl fabric, an undercoat layer of vinyl solvent based transparent coating, a graphics transfer of vinyl based paint bonded to the front of the undercoating, and, an exterior coating layer of vinyl solvent based transparent coating over the front of the graphics and the undercoating, the exterior coating combining chemically with the graphics and bonding it chemically to the undercoating.

1 Claim, 7 Drawing Figures

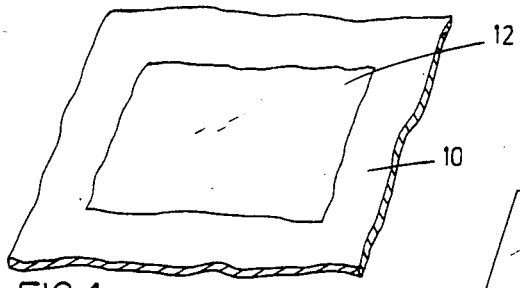
FIG. 1.
FIG. 2.
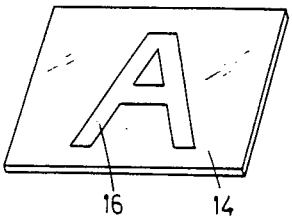
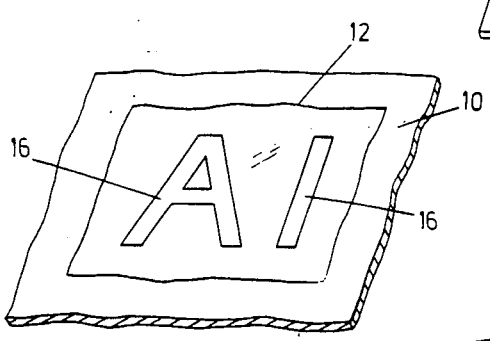
FIG. 3.
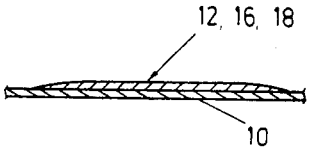
FIG. 6.
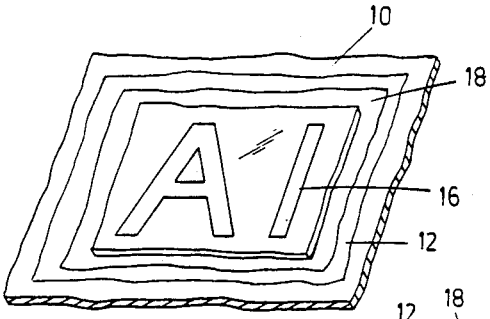
FIG. 4.
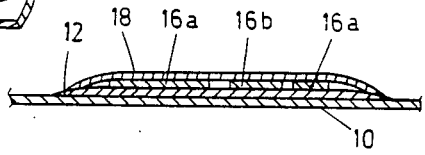
FIG. 7.
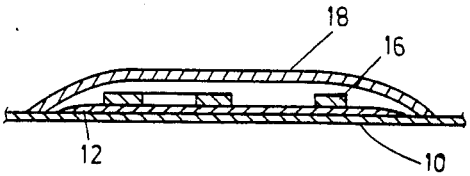
FIG. 5.

FABRIC SIGN PANEL

NATURE OF THE INVENTION

The invention relates to the colouring or lettering of a panel of flexible vinyl fabric material.

BACKGROUND OF THE INVENTION

Vinyl fabric materials are in wide use for information panels and commercial signs. Such material comprises essentially a woven fabric formed of non-elastic polyester fibre, which is dipped in liquid vinyl. The fabric has excellent qualities for outdoor use, and is highly resistant to damage by extremes of weather temperature, water, ice, snow, etc. and is also resistant to wind damage. When made, it is usually white in colour. It can readily be coloured with vinyl paints, and lettering can be applied.

It is however, most usually the case that particularly for a business sign, some form of customized art work will be required. Such art work may involve custom hand lettering of a business name, or a business logo, or a particular colouring or pattern of colours.

The creation of graphics involves numerous steps. In the first place, an artist must actually create the art work and the lettering. This is usually created on a paper or other fillament as a background. This art work is then usually photographed, or transferred in some other way to a colour medium. Such medium may be a printing plate, or a silk screen, or any other medium whereby the artist's original art work can be transferred.

From such printing medium for example, a silk screen, the graphics are then transferred to a carrier or transfer sheet, in a particular colour or combination of colours. Silk screening in particular may involve screening of one colour or up to four colours to provide a complete range of colours.

Where the graphics are too large or the volume is not sufficient for silk screeing, then pre-coated transfer sheets are used. These transfer sheets are pre-coated with different coloured paints. The graphics can simply be cut out, letter by letter if needed, to create transfer panels.

Typically, the base material is a paper or similar material to which a heat sensitive release material had been applied.

In the past, it has been attempted to apply the graphics on such a transfer panel directly onto the vinyl fabric material. The material was placed in a press, and heat and pressure was applied. The release material was softened and the graphics were also rendered semi-liquid. The graphics penetrated the vinyl sheet. The paper barrier was then peeled off. This procedure has not proved entirely satisfactory however. The bond between the transfer panel and the vinyl fabric was not always completely successful.

In all cases, however, it meant that the entire panel of vinyl fabric had to be placed in a large press. This involved considerable capital cost.

This is clearly undesirable. It is desirable that the graphics can be transferred onto the vinyl fabric in a cold process without heat and pressure.

Numerous attempts have been made to overcome this problem and to obtain a better cold bond between the graphics and the vinyl fabric.

BRIEF SUMMARY OF THE INVENTION

With a view to overcoming these disadvantages, and providing an information panel in which the graphics are bonded securely and permanently to the vinyl fabric by a cold process, the invention comprises a vinyl fabric sign comprising a an opaque panel of vinyl fabric material having a front and a back, an undercoating layer of resoftenable vinyl solvent based transparent coating applied at least to the graphics area of such fabric material, an intermediate graphics transfer formed of vinyl based paint bonded to such area of vinyl solvent based coating material, and an front coating layer of vinyl solvent based transparent coating material applied completely over said graphics transfer and said undercoating layer of vinyl solvent based coating material, said front coating layer combining chemically with said graphics transfer, and bonding the same chemically directly to said undercoating layer, whereby to provide a permanent bond of said graphics to said vinyl fabric.

More particularly, it is an objective of the invention to provide a method for making such a panel which may be performed without the application of heat, and without the requirement for costly machinery for applying pressure to such fabric.

More particularly, it is an objective of the invention to provide such a method wherein the step of application of the graphics transfer to the undercoat comprises the application of a graphics transfer panel consisting of a sheet of paper, and vinyl based paint, to the undercoat layer, followed by the application of water onto the transfer panel, and the smoothing of said transfer panel over said undercoat layer whereby to soften the paper and remove excess quantities of such water, and peeling away the paper carrier, leaving the graphics in place.

It is a further and related objective of the invention to provide such an information panel wherein the graphics comprises background areas of solid paint, and information areas defined by openings in said paint.

More particularly, it is an object of the invention to provide such an information panel wherein there are two such graphics layers, namely, a first layer comprising background graphics material, and spaces in said background layer which are clear, and a second graphics layer characterized by graphics of a different colour shaped to correspond to and register with said clear portions of said first layer.

The various features of novelty which characterized the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

IN THE DRAWINGS

FIG. 1 is a perspective illustration of a first stage in the method;

FIG. 2 is a perspective of a graphic transfer panel;

FIG. 3 is a perspective of a second stage;

FIG. 4 is a perspective of a third stage;

FIG. 5 is a schematic section along the line 5—5 of FIG. 4;

FIG. 6 is a schematic section showing the result after merging of the layers with the fabric, and, FIG. 7 is a schematic section similar to FIG. 5 through an alternate embodiment.

Referring now to FIGS. 1, 2 and 3 it will be seen that this embodiment of the invention is illustrated in relation to a portion of vinyl fabric panel indicated generally as 10.

Such vinyl fabric is well known in the trade, and comprises a woven non-elastic polyester fibre material, which has been dipped or otherwise coated with vinyl plastic, to make a flexible fabric. Such flexible fabric is highly resistant to weather and the rays of sun, wind damage and the like, and is particularly suitable for use in construction of outdoor signs such as are used at business locations, traffic direction and the like. Such fabric can also be used to construct actual portions of buildings such as awnings, and portions of tents or other building coverings. The vinyl plastic is re-softenable when a vinyl solvent, or a coating containing a vinyl solvent, is applied to it.

It can equally well be used as an interior form of signage or decoration. It can be erected in a variety of ways. For example, a panel of such fabric can simply be provided with securing means such as tapes or grommets around its edge and it can be strung on a frame. It can alternatively be shaped around a pre-shaped frame such as in an awning or tent structure. It also finds wide usage in the construction of illuminated business signs. Such signs are typically illustrated in U.S. Pat. No. 4,265,039. In this form of sign, a rectangular face framework is provided with some form of anchoring means around its perimeter. The flexible fabric is stretched across such frame somewhat in the manner of a drum skin.

Lighting tubes located within a box behind the face frame illuminate the sign from behind.

The use of such flexible fabric signs in an illuminated business sign may require that the background of the sign may be imprinted with one colour, and the graphics or information carried by the sign may be imprinted in another colour. In order to avoid mismatching or distortion of colours, it is desirable that the areas of different colour shall be separated on the sign.

In the normal case, the vinyl fabric material is produced in a whitish colour. Obviously, where th background colour or the graphics information are required to be shown in white, then the problem is simplified. However, in the majority of cases the sign will be designed to use at least two colours and may use more.

It is thus desirable to have a system for applying graphics to the fabric panel which is adaptable to the application of one or more different colours.

In the past, this has been carried out by a hot transfer method. Transfer panels of graphics were first of all prepared, usually by silk screening, and such transfer panels were then bonded to the vinyl by heat and pressure.

This required a substantial investment in machinery, and considerably increased the price of the finished information sign. The cost restricted the use of such machinery to the point where it was not available to all sign manufacturing companies, due to lack of funds.

Referring now the FIGS. 1, 2 and 3, the invention in its basic form will be seen to comprise the steps shown in FIGS. 1, 2 and 3.

In FIG. 1, a portion of a vinyl fabric 10 is shown, to the front of which has been applied a clear undercoat layer of vinyl based coating 12. Typically this will be a spray coating, and will be similar to for example, transparent vinyl laquer, in a volatile solvent.

Such an undercoat layer is applied over a pre-determined area which is greater than the area to which the subsequent graphics will be applied, for reasons to be described below.

The undercoat is preferably saturated with solvent, and the solvent softens the vinyl in the fabric panel so that the undercoat merges into the fabric panel.

The undercoat layer shown as 12 is then allowed to dry and cure.

It will be appreciated that the graphics will have been created separately, typically having been produced by silk screening, and will be carried on a backing or carrier sheet of paper 14.

In FIG. 2, such a panel 14 is shown with graphics 16 imprinted thereon. Typically, the backing layer 14 will be paper, or the like, and the graphics 16 will be imprinted or coated on the backing typically in a flexible vinyl paint or ink.

The panel 14 is applied to undercoat layer 12 with the graphics 16 sandwiched between the panel 14 and the undercoat layer 12.

The panel 14 and graphics 16 are such that when water is applied to soften panel 14, it can be peeled away, leaving the graphics in place. For this purpose a water soluble coating may be applied between the panel 14 and graphics 16 to assist in the separation. Such coatings are well known in the art of making transfers. Egg white, gelatin and the like have been used for this purpose. The panel 14 and graphics 16 may be die cut from a sheet of solid colour ie., paint, or paper. The panel will thus be of identical shape to the graphics. In the case of larger signs, this will be the usual method. On smaller signs, or where several colours are involved, the graphics may have been silk screened onto such a backing panel.

The panel 14 and graphics 16 are applied over the undercoat layer 12. Panel 14 is wetted and smoothed out to eliminate all bubbles of air or pockets of water, and to ensure a smooth intimate contact. To speed up the process the panel 14 may be soaked in a water tank prior to application.

The excess water is wiped away, and the panel is peeled away, leaving the graphics 16 in place. Any remaining water is removed, for example by a drier.

As shown in FIG. 3, the sign is completed by the application of an outer front coating layer 18. The outer coating layer 18 is formed of a clear vinyl based coating, carried in a volatile solvent, and drying to a clear crystal finish.

The front coating layer 18 is applied completely over the graphics 16 and also over the undercoat layer 12. As noted above, the undercoat layer 12 is applied over an area somewhat greater than that of the graphics, so that the graphics in the end will effectively be sandwiched completely between the undercoat layer 12 and the top coat layer 18.

The solvent of the top coat layer 18 when it is in the stage of application, and before it is cured, will penetrate and partly dissolve or soften the graphics and the undercoat. This will then cure and procure a good chemical bond of the graphics directly to the undercoat layer 12, and vinyl panel 10.

In this way, all three layers are effectively merged or welded together, and the end result is a highly effective bond directly into the vinyl panel 10, which is highly resistant to wind, weather, temperature, the sun and abrasion.

The use of the system is such that virtually any form of graphics can be applied, whether such graphics are created by silk screening, or for example by hand application, or by the use of stencils, or even by actual printing on a printing press.

The several layers are shown in schematic section in FIG. 4. The actual dimensions of the layers are of course greatly exaggerated for the purpose of illustration.

In practice the section showing multiple layers, as in FIG. 4, is only a transition phase.

The effect of the front coating layer 18 is to cause solvent to penetrate the graphics 16 and undercoat 12. This in fact causes such layers to return to soften and return to a semi-plastic state for a few minutes. During this time the three layers merge into one and penetrate the surface of the vinyl fabric 10 itself. In the end, the three layers can scarcely be detected by touch, but appear as a layer of ink would appear, as illustrated in FIG. 5.

The method as described in relation to FIGS. 1, 2 and 3 is of course capable of wide variation to produce different artistic or graphics effects. Thus, two or more such sets of graphics 16 can be applied to produce successive layers of graphics. Thus, if desired, different colouring effects can be applied by applying one set of graphics directly over the other.

In the particular case of an illuminated sign, it may be desirable to provide contrasting and distinct areas of colour. For this purpose, the graphics will preferably be made up so that the graphics on one panel will define open areas or clear spaces, and the graphics on the second panel will correspond with some or all of such open areas or spaces.

A sign made up with multiple graphics will thus have successive graphics 16*a*, 16*b*, etc. shown interfitting with one another, in different areas.

Such a modified form of sign is shown in schematic section in FIG. 6. Again the thickness of the various layers and panels is greatly exaggerated for the sake of illustration and clarity.

When applying two or more layers of graphics, each layer is applied in sequence. When the last layer of graphics has been laid down, the front coating layer of solvent based vinyl laquer is applied. This produces a simultaneous softening of all the graphics layers with the undercoat, and subsequent merging and curing in a single homogenous layer.

The foregoing is a description of a preferred embodiment of the invention which is given here by way of example only. The invention is not to be taken as limited to any of the specific features as described, but comprehends all such variations thereof as come within the scope of the appended claims.

What is claimed is:

1. A method of applying graphics to a vinyl fabric panel, for use as a sign or the like and comprising the steps of:

applying to a panel of vinyl fabric material, an undercoating layer in a liquid state, said undercoating layer comprising a vinyl solvent based transparent coating, said undercoating layer being applied in at least the region were said graphics are to be located, as allowing said undercoating layer to dry:

forming graphics on a transfer panel, said transfer panel incorporating a water soluble release material, and applying water to said transfer panel, whereby to release said graphics from said transfer panel, and deposit the same on said undercoating layer, and thereafter removing said transfer panel, and drying said graphics, and, applying and outercoating layer over said graphics and said undercoat layer, said outercoating layer comprising a transparent vinyl solvent based coating material in a liquid state, and allowing said outercoating layer to cure.

* * * * *